US007044217B2

(12) United States Patent
Hult

(10) Patent No.: US 7,044,217 B2
(45) Date of Patent: May 16, 2006

(54) STUFFING BOX FOR PROGRESSING CAVITY PUMP DRIVE

(75) Inventor: Vern Arthur Hult, Calgary (CA)

(73) Assignee: Oil Lift Technology, Inc., Calgary (CA)

( * ) Notice: Subject to any disclaimer, the term of this patent is extended or adjusted under 35 U.S.C. 154(b) by 187 days.

(21) Appl. No.: 10/638,737

(22) Filed: Aug. 11, 2003

(65) Prior Publication Data

US 2005/0011642 A1 Jan. 20, 2005

(30) Foreign Application Priority Data

Aug. 9, 2002 (CA) ..... 2397360

(51) Int. Cl.
*E21B 19/00* (2006.01)

(52) U.S. Cl. ..... 166/84.4; 166/84.5

(58) Field of Classification Search ..... 166/84.1, 166/84.4, 84.5; 277/329, 330
See application file for complete search history.

(56) References Cited

U.S. PATENT DOCUMENTS

| | | | | |
|---|---|---|---|---|
| 5,636,688 | A * | 6/1997 | Bassinger | 166/84.4 |
| 6,109,036 | A * | 8/2000 | Koike et al. | 60/534 |
| 6,257,117 | B1 * | 7/2001 | Yagishita | 91/169 |
| 2001/0050168 | A1 | 12/2001 | Hult | |
| 2002/0029569 | A1 * | 3/2002 | Nomura et al. | 60/560 |

FOREIGN PATENT DOCUMENTS

| | | |
|---|---|---|
| CA | 2095937 | 12/1998 |
| CA | 2311036 | 12/2001 |
| CA | 2350047 | 12/2001 |

OTHER PUBLICATIONS

Variseal Design Guide by American Veriseal, p. 7-4 entitled "Spring Energized Rotary Seals," downloaded from www.busakshamban.us.

* cited by examiner

*Primary Examiner*—William Neuder
(74) *Attorney, Agent, or Firm*—Terrance N. Kuharchuk; Rodman & Rodman

(57) ABSTRACT

Progressive cavity (PC) pump drive heads require a stuffing box to seal crude oil from leaking onto the ground where the polish rod passes from the crude oil passage in the wellhead to the drive head. Because crude oil typically contains fine sand particles, alignment between the stuffing box and the polished rod is imperfect, and PC drive heads run continuously, it is very difficult make stuffing boxes that last as long as desirable by oil production companies. By using a flexibly mounted standpipe in various configurations, around which is a bearing supported shaft carrying the sealing means, long term durability of the stuffing box can be achieved. By using a pressurization system such that the pressure output exceeds the pressure at the wellhead, stuffing box seal life can be extended and external leakage from the stuffing box can be eliminated. A double wall standpipe may be provided in some applications as part of the pressurization system. In some cases pressurization of the stuffing box is sufficiently advantageous that a floating standpipe is not economically warranted.

58 Claims, 11 Drawing Sheets

STUFFING BOX FOR PROGRESSING CAVITY PUMP DRIVE

FIELD OF THE INVENTION

The present invention relates generally to improvements in stuffing box configurations for progressing cavity (PC) pump drive head installations.

BACKGROUND OF THE INVENTION

Surface drive heads for progressing cavity pumps require a stuffing box to seal crude oil from leaking onto the ground where the polished rod passes from the crude oil passage in the wellhead to the drive head.

Due the abrasive sand particles present in crude oil and poor alignment between the wellhead and stuffing box, leakage of crude oil from the stuffing box is common in some applications. This costs oil companies money in service time, down time and environmental clean up. It is especially a problem with heavy crude oil wells in which the oil is often produced from semi-consolidated sand formations since loose sand is readily transported to the stuffing box by the viscosity of the crude oil. It is very difficult to make stuffing boxes that last as long as desirable by oil production companies. Costs associated with stuffing box failures are one of the highest maintenance costs on many wells.

Conventional stuffing boxes are mounted below the drive head. Conventional stuffing boxes are typically separate from the drive head and are mounted in a wellhead frame such that they can be serviced from below the drive head without removing it. A conventional stuffing box uses braided packing that is split so it can be replaced while the polished rod stays inside the stuffing box. Since conventional stuffing boxes seal against the polished rod, which is subject to wear, and due to poor alignment of the polished rod to the stuffing box, leakage becomes somewhat inevitable. Due to this experience, users tend to expect stuffing box leakage if the stuffing box uses braided packings.

In order to reduce or eliminate the leakage, high-pressure lip seals have been used running against a hardened sleeve rather than against the polished rod. Grenke in Canadian Patent No. 2,095,937 issued Dec. 22, 1998 shows a typical stuffing box employing lip seals. These stuffing boxes are known in the industry as environmental stuffing boxes because they do not leak at all until the lip seals fail. Since these high-pressure lip seals are not split and are mounted below the drive head, they cannot be replaced with the polished rod in place so the drive head must be removed to service the stuffing box. Since the drive head must be removed to service the lip seals, the wellhead frame has been eliminated and the stuffing box is bolted directly to the bottom of the drive head on many drive heads now being produced. This type of stuffing box directly mounted to the drive head is shown in the above referenced Grenke patent. This product is made by Grenco Industries. These types of stuffing boxes are referred to as integral.

There are many types of rotary lip seals that might be applied to stuffing boxes for progressing cavity pumped wells. Grenco and other competitors have had some field success with the type described as flanged variseals in the American Variseal catalog. American Variseal is a member of Busak and Shamban Inc. This type of seal is made by a number of competitors. Generally these seals are machined from reinforced Teflon and they have a preload spring between two lips. The flange is convenient for mounting the seal and stabilizing it. Since the seals are Teflon based, they can operate without lubrication.

Servicing of stuffing boxes is time consuming and difficult. In order to service the environmental or integral stuffing boxes, the drive head must be removed which necessitates using a rig with two winch lines, one to support the drive head and the other to hold the polished rod. To save on rig time, the stuffing box is typically replaced and the original stuffing box is sent back to a service shop for repair.

Recently, Oil Lift Technology Inc. has introduced top mounted stuffing boxes to the industry, which allow the stuffing box to be serviced from on top of the drive head without removing the drive head from the well. These types of stuffing box are shown in Hult Canadian patent application 2,350,047 (the "Oil Lift Stuffing Box"). These top mounted stuffing boxes use a flexibly mounted "floating" standpipe around which is a bearing supported shaft carrying the rotary stuffing box seals. Typically the primary rotary stuffing box seal is braided packing since it has proven to last for a long time when running against the hardened, flexibly mounted standpipe. Braided packings made from Teflon and graphite fibres and been used most frequently. Kevlar cornered packings are often used for the first and last packing rings to prevent extrusion. Packings of this type are generally self lubricating which can also be an advantage in the present invention. Because the standpipe floats, it self aligns to the packing, reducing or eliminating run out and leakage compared to conventional stuffing boxes. Packings have very low resilience so reduction of run out is very important in prevention of leakage. In some cases the stuffing box is counter-pressurized, preferably by lubricating oil at a higher pressure than the wellhead pressure so if there is any leakage through the primary rotary stuffing box seal, lubricating oil goes down the well rather than allowing well fluids to leak into the drive head. In the most difficult applications, the use of pressurized lubricating oil has proven very beneficial in extending stuffing box seal life, demonstrating many times the stuffing box seal life compared to non-pressurized stuffing boxes.

SUMMARY OF THE INVENTION

Canadian patent application 2,350,047 (Hult) filed on Jun. 11, 2001 and laid open on Dec. 9, 2001 and U.S. Patent Application Publication No. US 2001/0050168 filed on Jun. 11, 2001 and published on Dec. 13, 2001 are in their entirety hereby incorporated by reference into this specification.

The present invention relates to improving the performance and serviceability of the Oil Lift Stuffing Box and to providing a series of stuffing boxes to retrofit to other wellhead drives either above or below the drive head.

The present invention relates generally to improvements in stuffing box configurations. The present invention also relates generally to improvements in seal configurations for stuffing boxes.

The present invention is applicable to top mounted stuffing boxes, bottom mounted stuffing boxes, integral stuffing boxes and stand-alone stuffing boxes.

Stuffing boxes according to the present invention may either be pressurized or non-pressurized.

Where the stuffing box is pressurized, the pressure may be applied through a fluid medium. The fluid medium may be any suitable liquid or gas. In some applications, the fluid medium is preferably a lubricating fluid such as lubricating oil so that the fluid medium is available to lubricate stuffing box or drive head components such as seals and bearings.

Where the stuffing box is pressurized, the pressure source may be comprised of any suitable pressure source, including a hydraulic drive system for the well, a separate pump, a pressurized chamber such as a chargeable pressure chamber, a pressure-intensifying cylinder, or combinations thereof. The pressure source may also consist of or be comprised of a hydraulic accumulator for maintaining or stabilizing the pressurization of the stuffing box. It is desirable that the pressurization fluid be 50 to 500 psi above the wellhead pressure so if the primary seal leaks, pressurization fluid leaks toward the wellhead rather than allowing well fluid to enter the stuffing box or drive head housing.

Where the stuffing box is pressurized, two rotary seals may be used with pressurization between the two seals. The first seal is a primary seal and has well fluid pressure on one side and pressurization fluid, preferably at higher pressure than the well fluid, on the opposite side. The second seal is a pressurization seal for containing or inhibiting the leakage of pressurization fluid within or from the stuffing box. The pressurization seal is subjected to pressurization fluid on one side and little or no pressure on the opposite side. Both the primary seal and pressurization seal may be comprised of any type of suitable rotary seal, including labyrinth seals, chevron packings, braided packings, foil packings, O-rings, lip seals, rotary oil seals or combinations thereof. Preferably the primary and pressurization seals are comprised of braided packings because of the ease of service. In some cases, such as using a pressurization fluid that is different than the lubricating fluid in the stuffing box or drive head, even small leakage past the pressurization seal is objectionable. In these cases, the pressurization seal is preferably a high pressure lip seal because these seals have lower leakage rates than braided packings. Where the stuffing box is pressurized, a circulation path is preferably provided for circulating pressure fluid which does leak within or from the stuffing box. This circulation path may in some applications facilitate lubrication by the pressure fluid of stuffing box or drive head components such as bearings or seals.

Where the stuffing box is non-pressurized, a controlled leakage path is preferably provided for well fluids to prevent or inhibit such fluids from entering the stuffing box bearings or the drive head. Two rotary seals are required with a leakage path for the escape of well fluids between these seals. The primary seal has well pressure on one side and is in communication with the leakage path on the opposite side so any well fluid that passes the primary seal escapes to the leakage path. The secondary seal is to prevent or inhibit well fluids that escape past the primary seal from flowing into the drive head or stuffing box housing, forcing said well fluids to drain out through the leakage path. The leakage path may comprise one or more passages and one or more holes in components of the stuffing box or the drive head. Preferably the leakage path includes a lantern ring disposed adjacent to holes through the main shaft thus permitting leakage to exit the drive head or stuffing box.

Stuffing boxes according to the present invention include rotary seals. The rotary seals may be comprised of any suitable rotary seal, including labyrinth seals, chevron packings, braided packings, foil packings, O-rings, lip seals, chevron seals, rotary oil seals or any combination thereof. Preferably the rotary stuffing box seal is comprised of braided packings or lip seals or a combination of braided packings and lip seals.

Stuffing boxes according to the present invention may utilize a rigidly mounted standpipe or a flexibly mounted "floating" standpipe for improving the performance of the stuffing box seal. Where a standpipe is utilized, the standpipe may be either a single wall standpipe or a double wall standpipe. A double wall standpipe is useful for facilitating a pressurized stuffing box in which the pressurization seal is serviceable from on top of the stuffing box or drive head. Preferably, the pressurization seal is comprised of braided packing or a lip seal or a combination thereof.

In order to pressurize the Oil Lift integral Stuffing Box illustrated by prior art FIG. 1, a labyrinth seal acting as the pressurization seal has been used between the drive gear (FIG. 1 illustrates a labyrinth created by a labyrinth ring sealing against the drive gear but the inner bearing race, the shaft itself, a bearing spacer or any concentric surface that rotates with the shaft can be used) and a labyrinth ring sealed to the drive head housing. A labyrinth seal has been used because it is non-wearing, but due to its location in the drive head it is impossible to service without disassembling the drive head. It has also been found that good labyrinth sealing in that location is difficult to achieve due to run out between mating parts and the need for tight tolerances.

In one aspect of the present invention, the need for a non-serviceable labyrinth seal located between the housing and main shaft (or an equivalent) in pressurized stuffing boxes according to preferred embodiments of the invention has been eliminated by use of a double wall standpipe and a rotary seal instead of a labyrinth acting as the pressurization seal. The principle is an upper primary rotary seal and a lower rotary pressurization seal located in the annulus between the standpipe and the shaft, with pressurization means connected through passages in the standpipe communicating with the annular area between the upper and lower seals, said seals being field serviceable by removal and replacement through the top of the stuffing box or drive head. In the preferred embodiment, the upper and lower rotary seals are braided packings separated by a preload spring or a lantern ring because of the ease of service and durability of this type of seal. In some cases, such as using a pressurization fluid that is different than the lubricating fluid in the stuffing box or drive head, even small leakage past the pressurization seal is objectionable. In these cases, the pressurization seal is preferably a high pressure lip seal because these seals have lower leakage rates than braided packings.

Abrasive particles in the well fluid cause wear of the standpipe and it must be periodically replaced. Another aspect of the present invention is that the standpipe can be inspected and replaced without removing the stuffing box or drive head from the well.

Another aspect of the present invention is that in some preferred embodiments, two different fluids can preferably be used inside the drive head. Hydraulic pressure, from the hydraulic system driving the drive head, can preferably be used to pressurize the stuffing box. The lower bearings and gears can preferably be lubricated with gear oil. Unlike using a labyrinth seal as the pressurization seal, a pressurization seal such as braided packings or lip seals can be used in conjunction with a double walled standpipe so there is negligible flow of pressurization fluid into the lower bearings and gears of the stuffing box or drive head, thus keeping the hydraulic oil out of the gear oil in this example.

In another aspect of the present invention, a non-pressurized stuffing box can be achieved using a flexibly mounted standpipe around which is a rotating shaft mounted on bearings in a housing. The primary rotary seal is located in the annulus between the standpipe and the shaft. This configuration can be used for a top mounted stuffing box as part of a drive head or as a stand-alone stuffing box that can be retrofitted below existing drive heads, preferably in a wellhead frame which supports a drive head above the stuffing box of the present invention. Since there is no pressurization system, leakage of well fluids past the primary seal toward the stuffing box or drive head will occur. A leakage path is provided to allow escape of well fluids. A secondary seal is provided to prevent well fluids from entering the drive head or stuffing box housing. Improvements in this system over Hult Canadian patent application 2,350,047 are shown in greater detail with reference to the drawings.

In some cases, it is not economic or practical to provide a pump to pressurize the stuffing box. In these cases, a pressure intensification cylinder assembly can be added in conjunction with the stuffing box so that a pressure fluid is made available at a pressure above the wellhead pressure.

In some cases, hydraulic pressure is readily available to provide for stuffing box pressurization. However, a standpipe system requires a large main shaft and large bearings, which may be too expensive for some applications. In these cases, a bottom-mounted stuffing box with a pressurization system may be an economic solution. The stuffing box may be integral with the drive head and mounted on the bottom of the drive head by flanges, for example. The stuffing box may also be a stand-alone stuffing box mounted in a wellhead frame with the drive head mounted above the stuffing box on a wellhead frame.

In another aspect of the present invention, a stuffing box can be constructed with a non-rotating tubular shaft bearingly supporting a rotating housing. The bearings may be lubricated with the pressurization fluid as it travels into the lower side of the primary rotary seal. This configuration is simpler to construct than a double wall standpipe but it uses more length and does not align the standpipe and the housing as well as the double wall standpipe configuration. This is because the housing is cantilevered from the bearings.

BRIEF DESCRIPTION OF THE DRAWINGS

Aspects of the present invention demonstrating the concepts of the present invention are illustrated, by way of example in the enclosed Figures:, in which:.

DESCRIPTION OF THE DRAWINGS AND OF PREFERRED EMBODIMENTS

Throughout the descriptions, components that have the same function have the same number. For example, the function of static seals 126 are described in the description of FIG. 4 so they are not described again in subsequent Figures, such as FIG. 8. Since the number 126 is the same in both Figures, the reader may assume that the function is the same in this and all other Figures where the same number appears.

Figure 1:
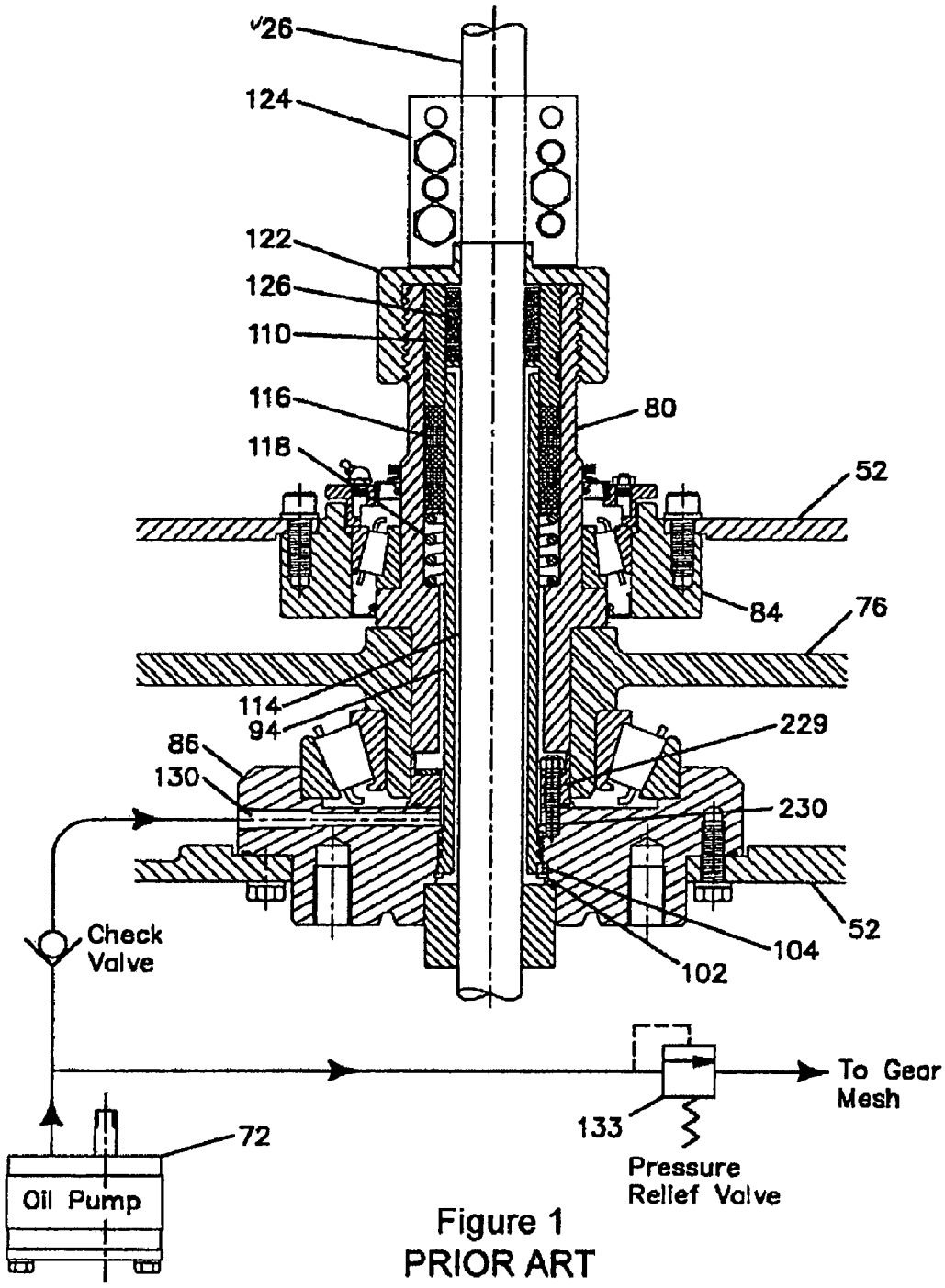
Figure 1 PRIOR ART
FIG. 1 is a cross sectional view of the prior art stuffing box with floating standpipe and labyrinth seal shown as FIG. 6 in Hult Canadian patent application 2,350,047.
Figure 6:
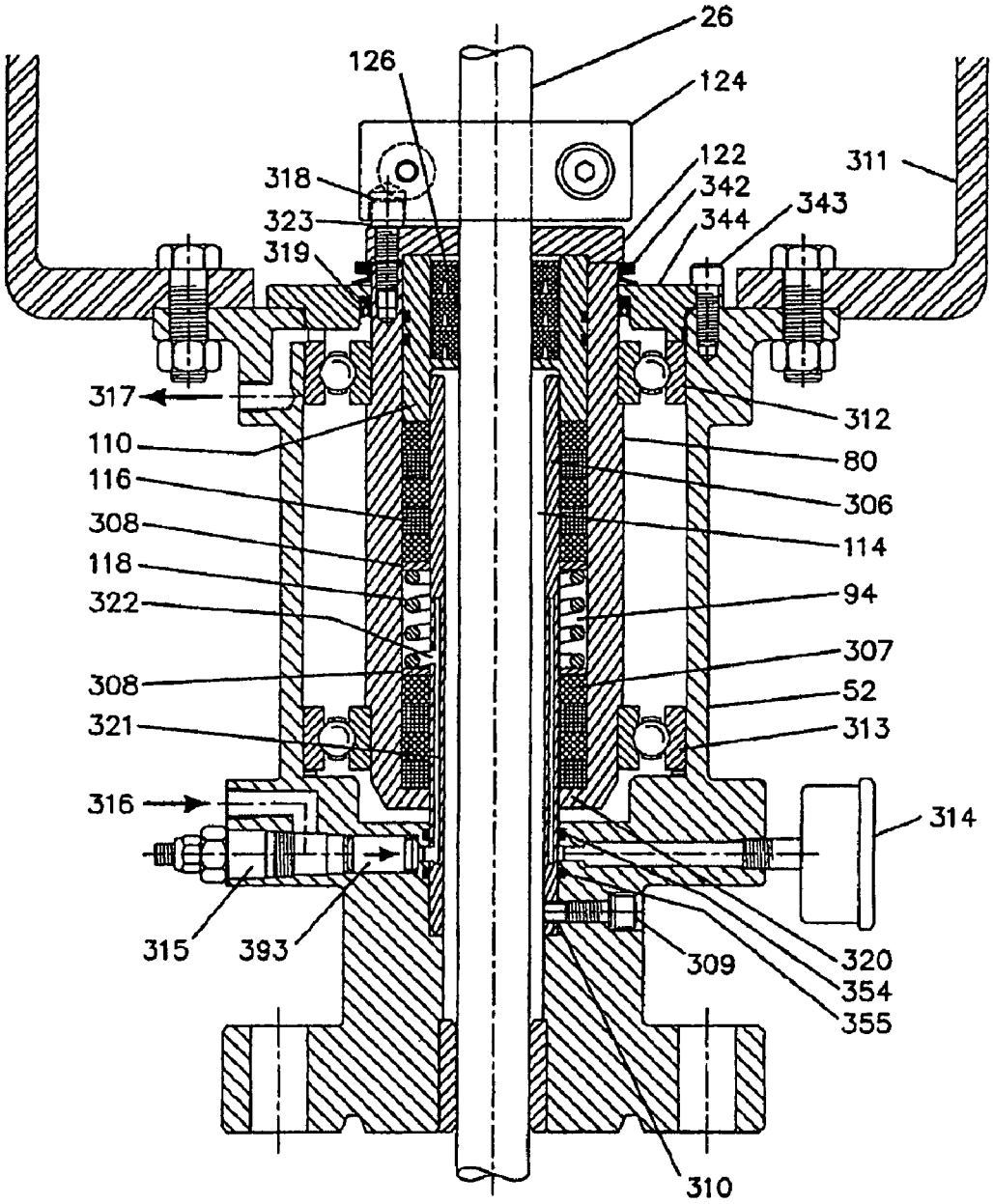
FIG. 6 is a preferred embodiment of a stand-alone stuffing box mounted in a wellhead frame, said stuffing box including a floating double wall standpipe and a pressurization system.

FIG. 1 is a cross sectional view of the prior art stuffing box with floating standpipe and labyrinth seal shown as FIG. 6 in Hult Canadian patent application 2,350,047. Identification numbers in FIG. 1 correspond to FIG. 6 of the patent application.

Figure 2:
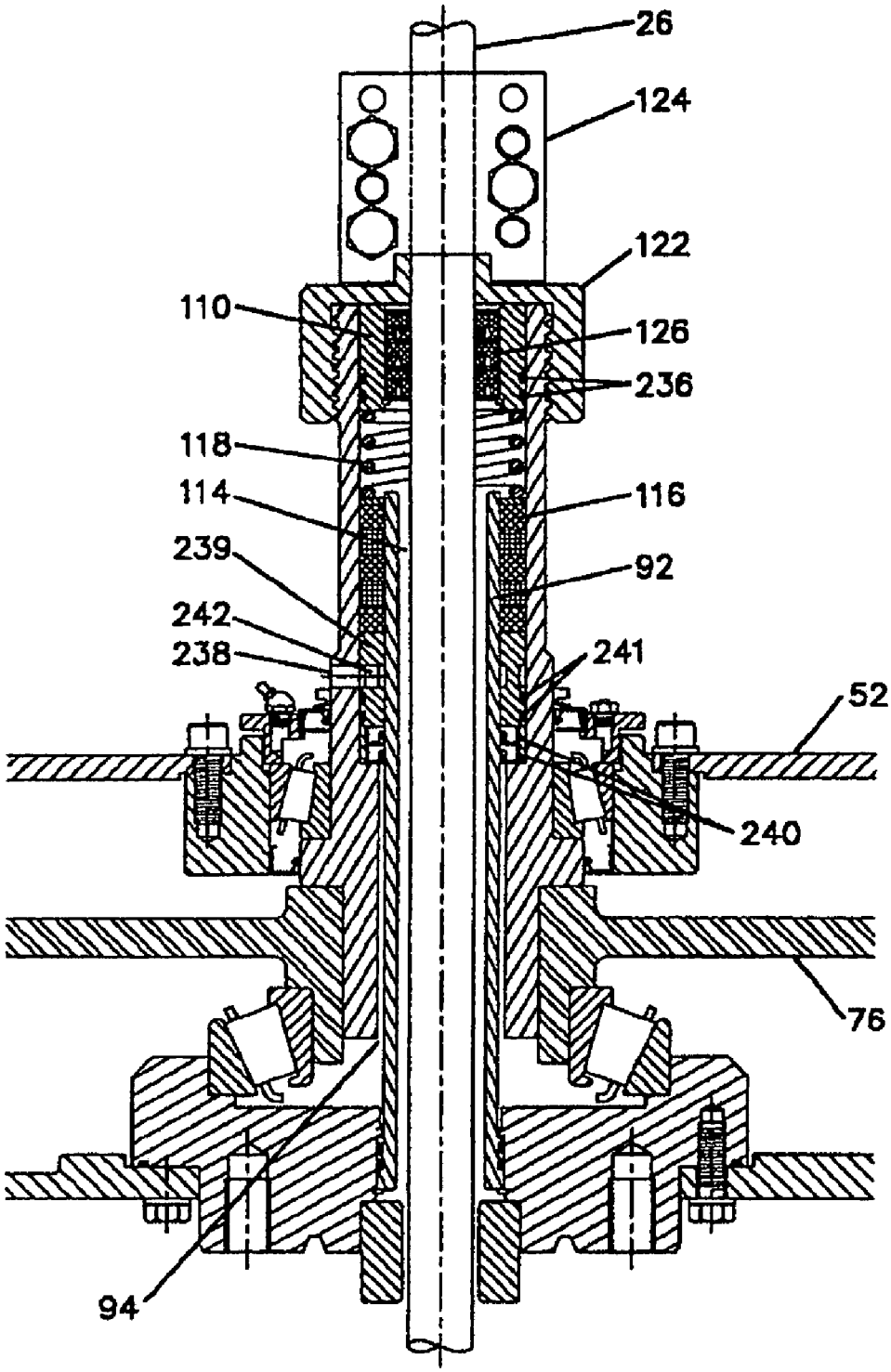
Figure 2 PRIOR ART
FIG. 2 is a cross sectional view of the prior art stuffing box with floating standpipe but no pressurization system, shown as FIG. 8 in Hult Canadian patent application 2,350,047.
Figure 8:
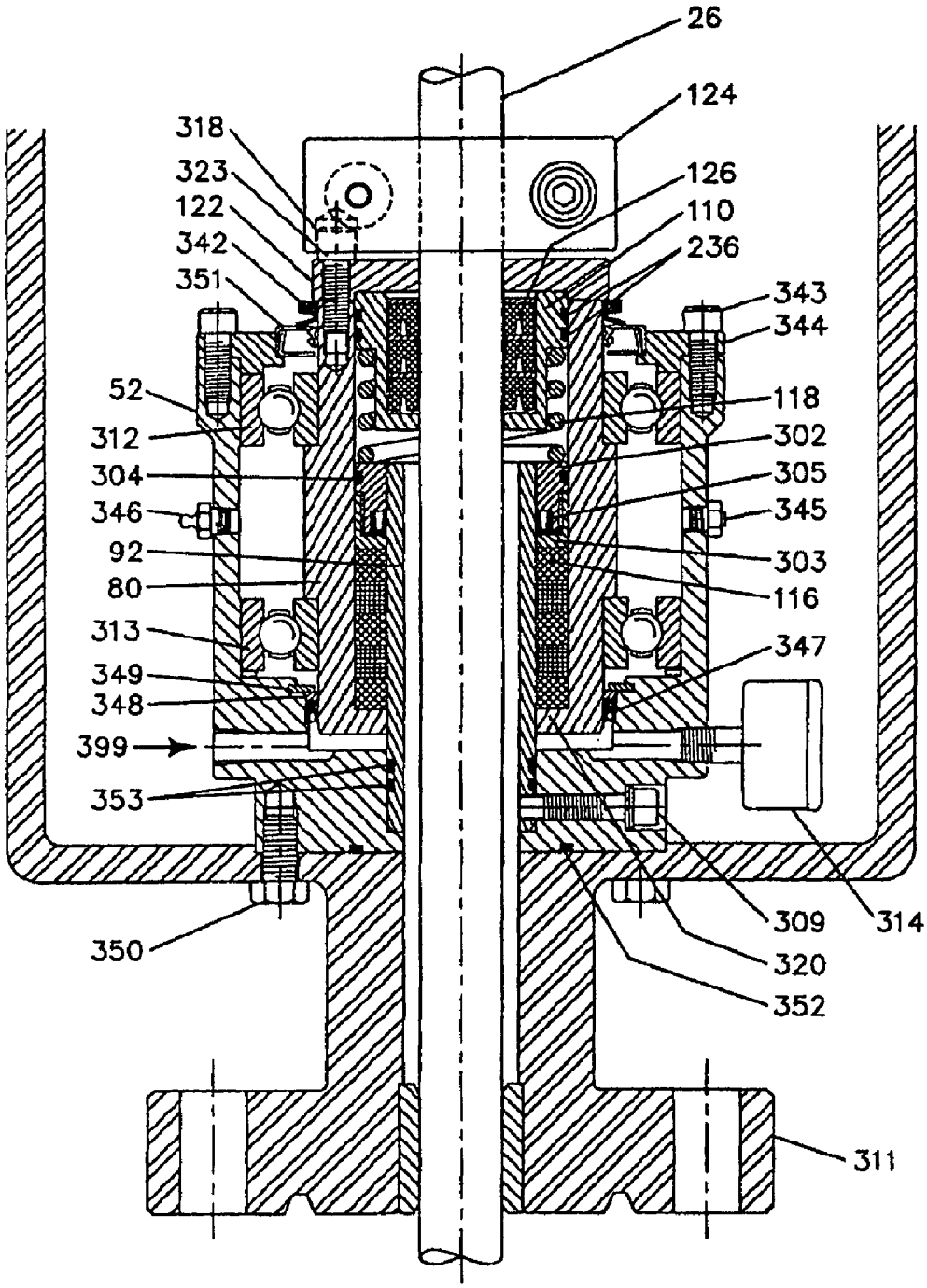
FIG. 8 is a preferred embodiment of a stand-alone stuffing box mounted in a wellhead frame using a floating single wall standpipe without a pressurization system.

FIG. 2 is a cross sectional view of the prior art stuffing box with floating standpipe but no pressurization system, shown as FIG. 8 in Hult Canadian patent application 2,350,047. Identification numbers in FIG. 2 correspond to FIG. 8 of the patent application.

Figure 3:
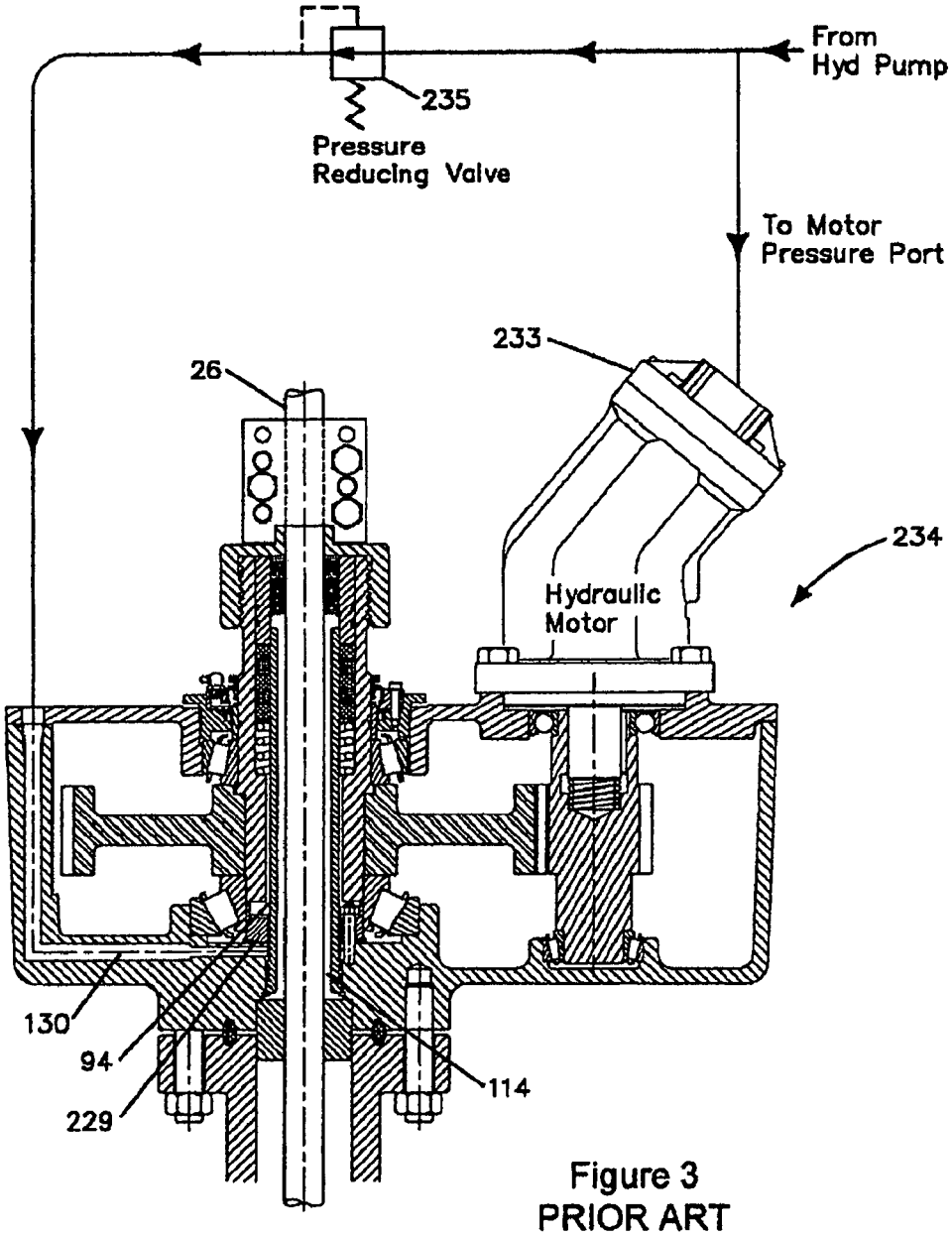
Figure 3 PRIOR ART
FIG. 3 is a cross sectional view of the prior art stuffing box pressurized from the hydraulic system, shown as FIG. 9 in Hult Canadian patent application 2,350,047.
Figure 9:
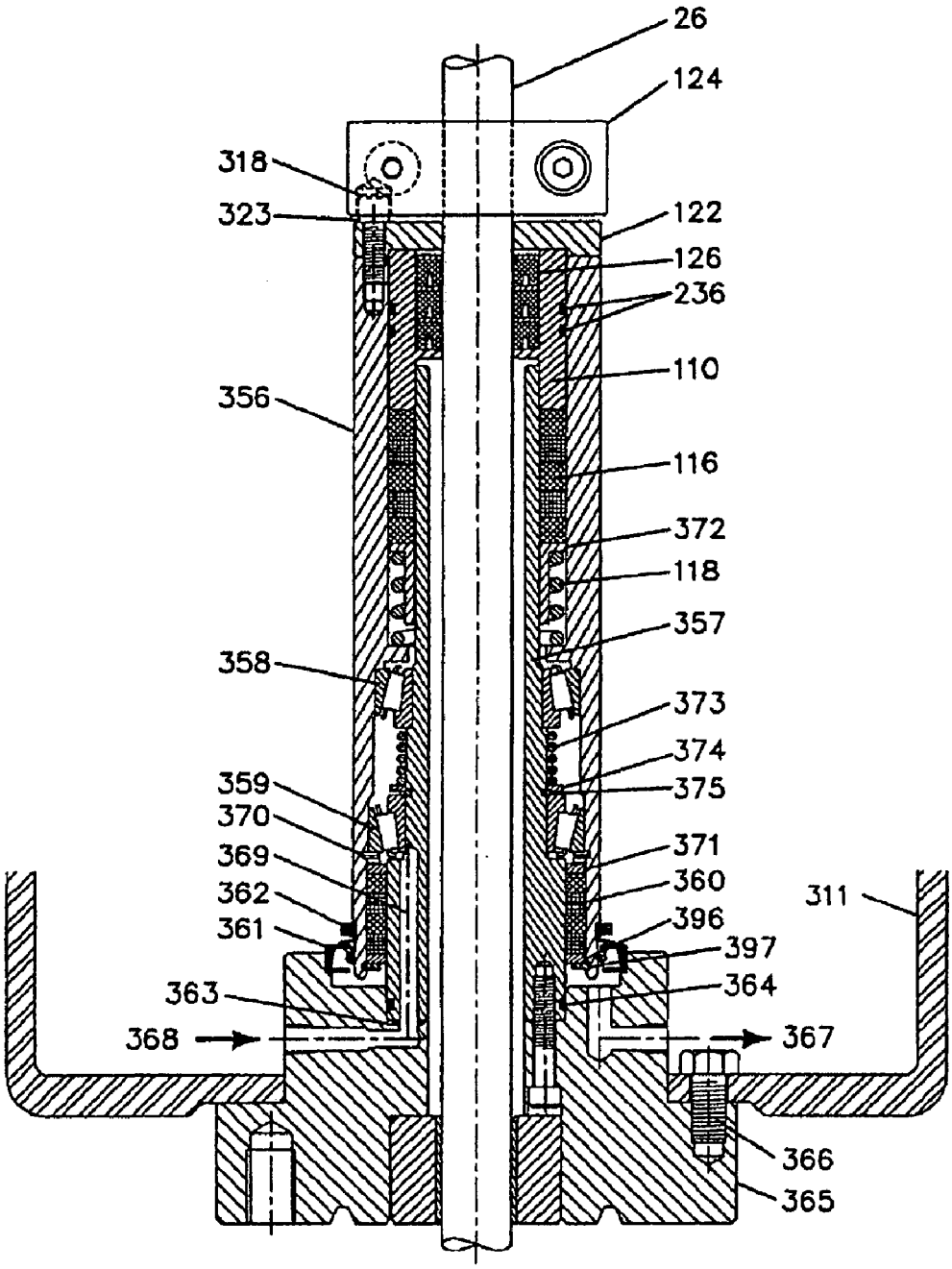
FIG. 9 is a preferred embodiment of a stand alone stuffing box constructed with a non-rotating tubular shaft bearingly supporting a rotating housing.

FIG. 3 is a cross sectional view of the prior art stuffing box pressurized from the hydraulic system, shown as FIG. 9 in Hult Canadian patent application 2,350,047. Identification numbers in FIG. 3 correspond to FIG. 9 of the patent application.

Figure 4:
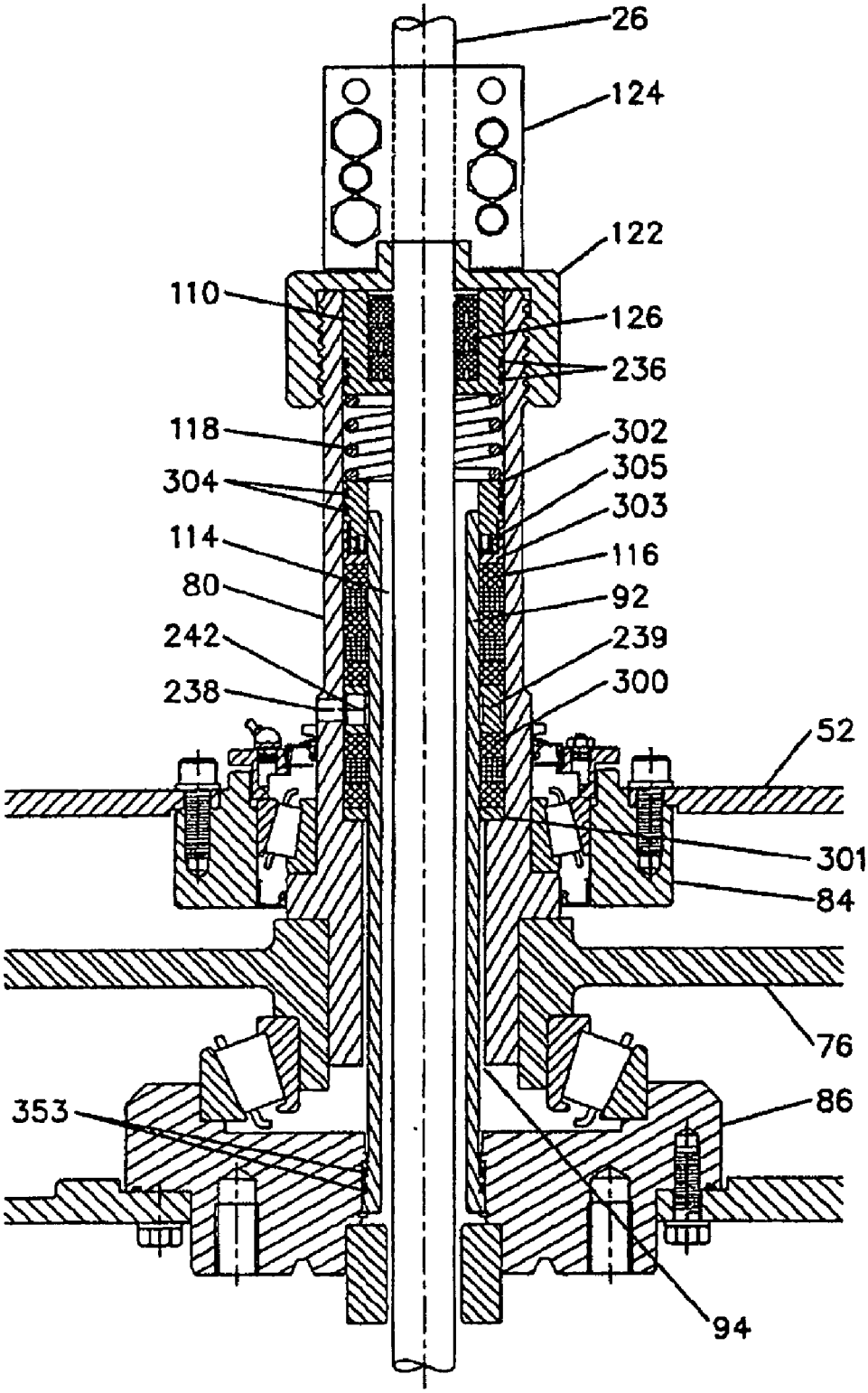
FIG. 4 is a cross sectional view of the preferred embodiment of a stuffing box including a floating single wall standpipe but without a pressurization system.

FIG. 4 is a cross sectional view of the preferred embodiment of a stuffing box with a floating single wall standpipe but without a pressurization system. It is an improvement compared to FIG. 2 since braided packings or high pressure lip seals can be used instead of the low pressure elastomeric lip seals shown in FIG. 2. Braided packing materials and high pressure lip seals made from reinforced Teflon are self-lubricating whereas elastomeric lip seals are not and as a result they would wear out. Additionally, a high pressure lip seal can be fitted above the packings with benefits described below.

The preferred embodiment shown in FIG. 4 will be used as a reference to describe in detail the essential elements of a non-pressurized stuffing box using a standpipe. Whether the stuffing box is separate from (stand-alone like FIG. 6 and FIG. 7) or is integrated into the drive head, the essential elements are related. Although FIG. 4 illustrates an integral stuffing box, a stand alone stuffing box can be constructed with the same elements. A housing 52, often preferred (because of machining and assembly considerations) with separable upper bearing cap 84, and separable lower bearing cap 86, supports a rotating shaft 80. Separable bearing caps, if any, are considered part of the housing. A non-rotatable standpipe 92 is mounted concentrically within the shaft and is detachably secured to the housing. The polished rod 26 is received concentrically through the standpipe. Annular passage 114 between the polished rod and the standpipe contains wellhead pressure.

Annular passage 94 between the standpipe and the shaft can be fitted with rotary seals. The top of the shaft has a removable drive cap 122 that is drivingly connected to the polished rod 26 by a drive clamp 124. Below the drive cap are static seals 126 to prevent the escape of well fluids around the polished rod. Preferably the static seals are supported in a static seal carrier 110 which is sealed to the shaft by seals 236. Seals 236 are preferably O-rings or similar common seals. The static seal assembly is hereby defined as the static seals, the static seal carrier and the seals 236. The drive cap, drive clamp, polished rod, shaft and static seal assembly, rotate together around the stationary standpipe. The static seals are referred to as 'static' because there is no relative rotary motion between the static seals and the polished rod and the static seal carrier. The only relative motion in the stuffing box is the rotary seals rotating against the standpipe. The standpipe preferably has a hardened surface to reduce wear of the standpipe and the rotary seals.

By removing the drive clamp, drive cap and static seal assembly, the rotary seals can be serviced from the top of the drive head or from the top of the stuffing box. Spring 118 serves to preload the primary seals 116 which are preferably braided packings against the lantern ring 239. Once the spring is removed, the lip seal assembly comprised of lip seal 305, lip seal carrier 302, lip seal retainer 303 and O-ring seals 304 sealing the lip seal carrier to the shaft can be removed. Preferably the lip seal carrier has one or more tapped holes to facilitate removal.

The primary rotary seal in the present embodiment is comprised of a lip seal assembly acting first against well fluids and a set of packings acting once the lip seal has failed. The use of a lip seal in conjunction with packings provides substantial improvements in stuffing box life. Since lip seals have very little leakage and do a good job of excluding contaminants in the well fluid, the lip seal protects the packing from any wear until the lip seal fails. The packing stays like new. Once the lip seal fails, the packings take over the sealing role. Essentially the stuffing box has two seals in series so the stuffing box life is equal to the lip seal life plus the packing life. Two lip seals have been used in series in Grenke Canadian patent 2,095,937 but the use of packings provides a substantial advantage. When a lip seal fails, leakage rates are very high and environmental damage can be severe. A packing starts to leak slowly and operators have a chance to repair the stuffing box before substantial leakage can occur. Use of two lip seals per Grenke provides longer stuffing box life and a resealable inspection port between the two lip seals can indicate when the first lip seal has failed. However, if maintenance checks are not done, both lip seals can fail, resulting in high leakage rates of well fluids and potential environmental damage. Use of packings prevents this.

Lip seals require accurate alignment between the rotating components. Since the standpipe self aligns to the rotary seals, the lip seal configuration in the present invention has substantial life advantages over the configuration used in Grenke Canadian patent 2,095,937. The Grenke configuration has a shaft extension that is cantilevered from the bearings supporting the shaft. Any misalignment at the bearings is multiplied at the rotary seals, unlike the present invention wherein the shaft is supported in bearings spanning the stuffing box.

Below the packings 116 is an escape passage for well fluids preferably comprised of a lantern ring 239 communicating with holes 238 though the shaft. The lantern ring preferably has an upper and lower inner diameter to provide a running clearance to the standpipe. The lantern ring preferably has an upper and lower outer diameter to allow a sliding fit to the inside diameter of the shaft. The inner diameter and the outer diameter has a radially relieved section adjacent to radial holes 242 to allow well fluid that has leaked past the packings to escape more readily through holes 242 and then into holes 238 through the shaft.

Below the lantern ring is the secondary rotary seal 300 which is preferably a set of packings or another lip seal assembly as described above and shown in FIG. 4 in the primary stuffing box seal location. Spacer ring 301 has a running clearance against the standpipe and serves to prevent the packing from extrusion into annular area 94. When a lip seal assembly is used as the secondary rotary seal, the lip seal carrier can be integrated with the lantern ring to reduce the number of parts and the spacer ring is not required.

Figure 5:
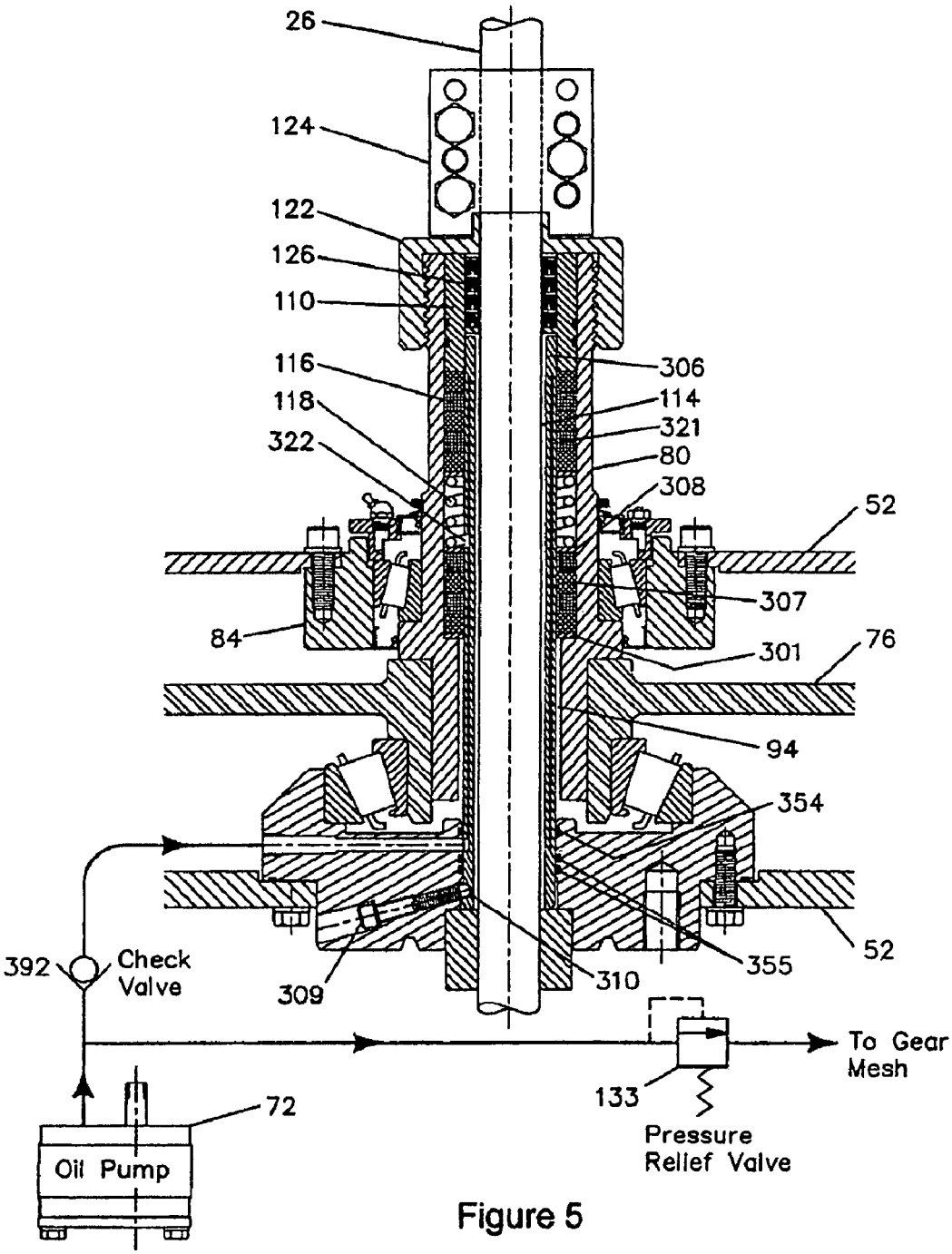
FIG. 5 is a cross sectional view of a preferred embodiment of a stuffing box including a floating double wall standpipe and a pressurization system.

FIG. 5 is a cross sectional view of a preferred embodiment of a stuffing box using a floating double wall standpipe pressurization system. The need for a labyrinth seal acting as the pressurization seal as shown in FIGS. 1 and 3 has been eliminated by use of a double wall standpipe 306 to convey pressurization fluid above a rotary seal, preferably a set of braided packings or a lip seal or combinations thereof, said rotary seal acting as the pressurization seal. Unlike the previous labyrinth seal shown in FIG. 1, the pressurization seal in this embodiment can be serviced in the field without removing the drive head from the well. Also in this embodiment, the standpipe can be removed for inspection and replacement without removing the drive head from the well.

In the FIG. 5 embodiment, the pressurization fluid is conveyed by a pressurization means such as a pump 72.

The preferred embodiment shown in FIG. 5 will be used as a reference to describe in detail the essential elements of a pressurized stuffing box using a double wall standpipe. Whether the stuffing box is separate from (stand-alone like FIG. 6 and FIG. 7) or is integrated into the drive head as shown in this embodiment, the essential elements are related. Although FIG. 5 illustrates an integral stuffing box, a stand-alone stuffing box such as FIG. 6 can be constructed with the same elements. A housing 52, often preferred (because of machining and assembly considerations) with separable upper bearing cap 84, and separable lower bearing cap 86, supports a rotating shaft 80. Separable bearing caps, if any, are considered part of the housing and will be henceforth referred to as such. A non-rotatable standpipe 306 is mounted concentrically within the shaft and is detachably secured to the housing. The polished rod 26 is received concentrically through the standpipe. Annular passage 114 between the polished rod and the standpipe contains wellhead pressure.

Annular passage 94 between the standpipe and the shaft can be fitted with rotary seals. The top of the shaft has a removable drive cap 122 that is drivingly connected to the polished rod 26 by a drive clamp 124. The connection between the drive cap and the shaft can transmit torque and support axial loads. Below the drive cap are static seals 126 to prevent the escape of well fluids around the polished rod. Preferably the static seals are supported in a static seal carrier 110 which is sealed to the shaft by seals 236. Seals 236 are preferably O-rings or similar common seals. The static seal assembly is hereby defined as the static seals, the static seal carrier and the seals 236. The drive cap, drive clamp, polished rod, shaft and static seal assembly, rotate together around the stationary standpipe. The static seals are referred to as 'static' because there is no relative rotary motion between the static seals and the polished rod and the static seal carrier. The only relative motion in the stuffing box is the rotary seals rotating against the standpipe. The standpipe preferably has a hardened surface to reduce wear of the standpipe and the rotary seals.

By removing the drive clamp, drive cap and static seal assembly, the rotary seals can be serviced from the top of the drive head or from the top of the stuffing box in the case of a stand-alone stuffing box, without removal from the well.

The primary rotary seals are preferably packings 116 or a combination of packings and lip seals as shown in FIG. 4. Below the packing 116 is a packing pusher ring 308 which has a running clearance against the standpipe and serves to prevent the packing from extrusion into annular area 94. Preload spring 118 acts with the pressurization fluid to push the packing toward the static seal carrier 110.

Below the spring is the pressurization rotary seal 307 which is preferably a set of packings or a lip seal assembly as described above and shown in FIG. 4 in the primary seal location. Spacer ring 308 above the packing 307 and spacer ring 301 below packing 307 have a running clearance against the standpipe and serve to prevent the packing from extrusion into annular area 94. The spacer rings are not required when a lip seal assembly serves as the pressurization seal.

The standpipe in this embodiment is called double walled because that is the preferred method of its construction. Other methods of construction would be possible as long as the standpipe functions to communicate pressure from a pressure supply to the stuffing box between the pressurization rotary seal and the primary rotary seal as described herein. Functionally, the double walled standpipe has internal passages to communicate pressure from the pressurization system to the annular area 94 between the primary rotary seal and the pressurization seal. A pressure connection to a passage in the housing is made where the standpipe is secured to the housing. Generally the inner wall is sealed to the housing and the outer wall is sealed to the housing and fluid is conveyed from the housing between these two seals, shown as items 354 and 355. Fluid is then conveyed in the annulus 321 between the outer and inner wall of the standpipe and then is conveyed radially through holes or passages 322 through the outer wall into annular passage 94 between the primary seal and pressurization seal.

By use of a double walled standpipe, both the pressurization seal and the primary seal can be replaced in the field without removing the drive head or stuffing box from the well. This is not possible with the labyrinth located in the position of FIG. 1.

Abrasive particles in the well fluid cause wear of the standpipe and it must be periodically replaced. Another aspect of the present embodiment of the invention is that the standpipe can be inspected and replaced without removing the stuffing box or drive head from the well by releasing retaining fastener 309 which is preferably a special bolt that fits radially into a retention hole or other suitable shape 310 in the standpipe. When the retaining fastener is in place the standpipe is prevented from rotation or axial movement. The retaining fastener is fitted with clearance into the retention hole to permit the standpipe to tilt to better align the standpipe to the rotary seals carried by the shaft.

The principle of configuring the standpipe securing means so the standpipe can be inspected or replaced can also be applied to the single wall standpipe shown in FIG. 4. In this case the standpipe requires only a single seal and a retention hole so it can be radially secured as described herein. FIG. 8 illustrates the principle.

FIG. 6 is a preferred embodiment of a stand-alone stuffing box mounted in a wellhead frame using a floating double wall standpipe and pressurization system. The drive head in this and all stand alone stuffing boxes is mounted on the top of the wellhead frame.

The essential elements of this stand-alone stuffing box are the same as a stuffing box integrated into the drive head in FIG. 5. The description of FIG. 5 applies to this stuffing box as well.

The principle whether integrated into a drive head or in a stand-alone stuffing box is an upper primary rotary seal and a lower rotary pressurization seal located in the annulus between the standpipe and the shaft, with pressurization means connected via inlet passage 316 through passages in the standpipe communicating with the annular area between the upper and lower seals, said seals being field serviceable by removal and replacement from the top of the stuffing box or drive head. In the preferred embodiment, the upper and lower rotary seals are preferably braided packings separated by a preload spring or a lantern ring because of the ease of service and durability of this type of seal. In some cases, the pressurization seal is preferably a high pressure lip seal because these seals have lower leakage rates than braided packings and they take less axial length. In the preferred embodiment, the stuffing box would be pressurized off the hydraulic system that is powering the drive head. The pressure from the hydraulic system is preferably reduced down to 50 to 500 psi above the wellhead pressure by the built in pressure-reducing valve 315. A check valve 393 is preferably used with pressurized stuffing boxes since it locks fluid into the annular area between the primary and pressurization seals and prevents shifting of these seals when well servicing may cause high wellhead pressure.

Pressurization fluid that escapes past the pressurization seal is preferably returned to the pressurization source though fluid passage 317.

Housing 52, non-rotatable standpipe 306, polished rod 26, annular passage 114, annular passage 94, static seals 126, static seal carrier 110, seals 236, static seal assembly, primary rotary stuffing box seals 116, packing pusher ring 308, preload spring 118, pressurization rotary stuffing box seal 307 and spacer ring 308 function as described in the description of FIG. 5.

When the stuffing box is integrated into the drive head, the polished rod clamp supports the polished rod load and transmits torque from the drive head to the polished rod. When the stuffing box is a stand-alone version, the polished rod is still supported and driven by the drive head. However, for the stand-alone version, the stuffing box is driven by the polished rod. Very little torque is required to drive the stuffing box so the drive clamp and its connection to the drive cap do not need to be as robust. The bearings 312 and 313 are not large enough to support the axial load of the polished rod so it is important that the rod clamp 124 does not rest against the drive cap 122 and apply axial load. Axial clearance space 323 should be visually apparent so an operator can be sure axial load is not being applied to the stuffing box bearings. The stuffing box functions the same in both cases.

Removable drive cap 122 is preferably secured to shaft 80 by fasteners 318. Preferably the fastener is an Allen head bolt that can protrude above the drive cap and be driven by corresponding recesses in drive clamp 124. Alternately, the drive cap and static seal carrier might be combined and the main shaft could be internally threaded to connect the combined static seal carrier/drive cap to the shaft. Other methods of connecting the drive cap to the shaft and transmitting torque from the drive clamp to the drive cap can be used. Determination of which connection is preferable depends on cost and space considerations.

In the preferred embodiment, spacer ring 301 has been eliminated but rather the shaft is made with a close running fit at location 320.

The passage 321 between the inner and outer walls of the standpipe and the passage 322 through the outer wall leading to the area between the seals are more readily apparent in FIG. 6 than in FIG. 5 but the passages are present in both embodiments and function the same in both.

Figure 7:
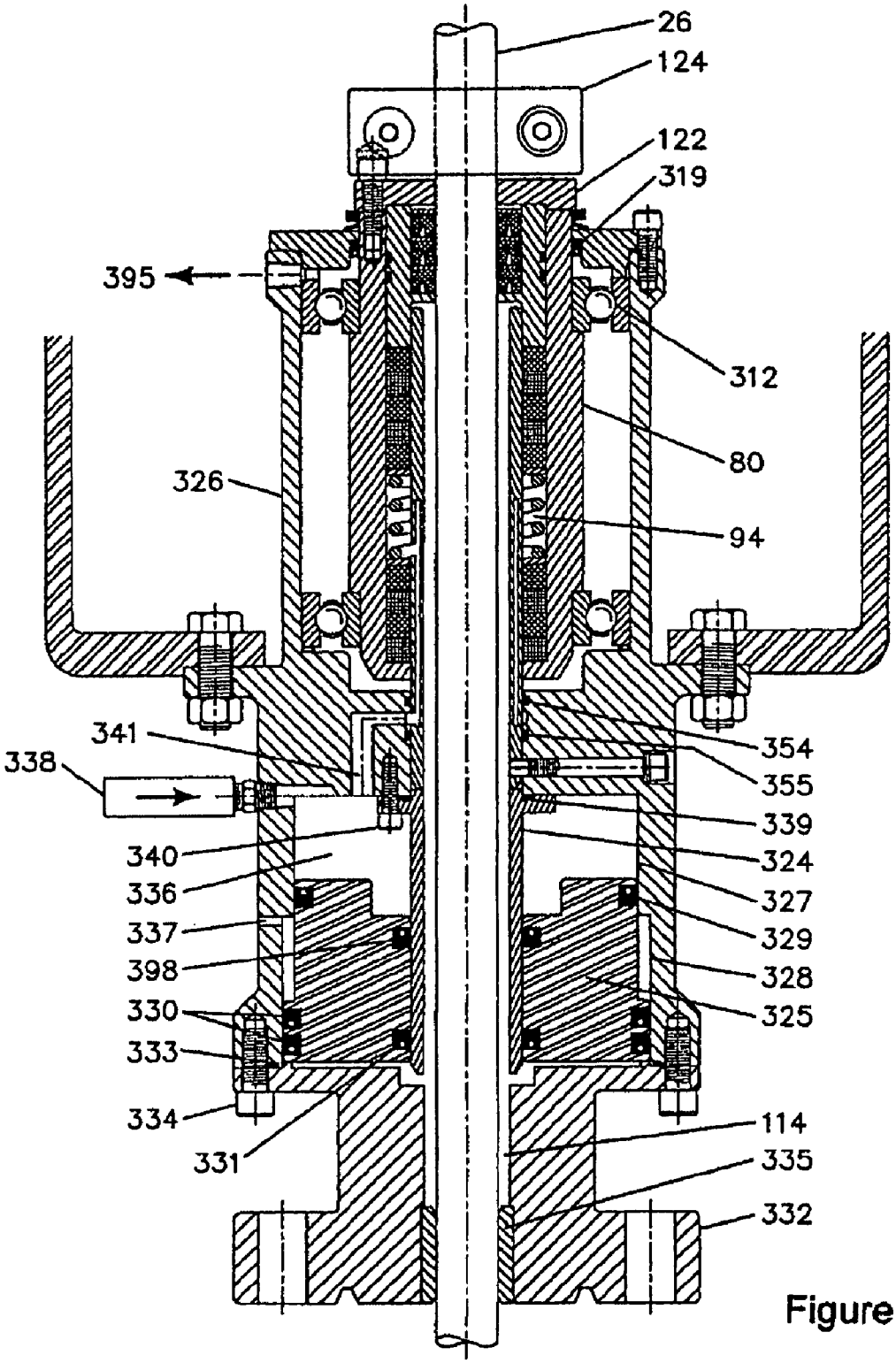
FIG. 7 is a preferred embodiment of a stand-alone stuffing box including a floating double wall standpipe and pressurization, said stuffing box mounted in a wellhead frame. Said pressurization source is a pressure-intensifying cylinder built below the stuffing box, surrounding the polished rod.

FIG. 7 is a preferred embodiment of a stand-alone stuffing box mounted in a wellhead frame using a floating double wall standpipe similar to FIG. 6. The stuffing box functions identically to FIG. 6, only the source of pressurization is different. In this embodiment, the pressurization source is a pressure-intensifying cylinder assembly located below the stuffing box, surrounding the polished rod. Grease or oil under pressure is pumped through valve 338 into the upper chamber 336 to push the piston 325 down. Wellhead pressure in annular passage 114 pushes on the bottom of the piston, urging the piston upward. Since the piston area on the wellhead side is larger than on the stuffing box side, oil or grease feeds into the stuffing box through passage 341 at higher pressure than the wellhead pressure. By mounting the cylinder assembly between the stuffing box and the wellhead, heat is conducted into the cylinder to prevent the cylinder from freezing. There are no separate fluid lines to freeze off in cold weather or be damaged during well servicing. It will be appreciated that this pressurization system can be used whether the stuffing box is a stand-alone version or is built into the drive head. This pressurization system could be used with any stuffing box that can employ a pressurization system.

Pressurization fluid that escapes past the pressurization seal is preferably returned to the pressurization source though fluid passage 395.

Components of the pressure intensification cylinder are a piston 325 fitting into cylindrical bore 328 of intensifier housing 326. The intensifier housing has a smaller diameter at bore 327 than at 328. The piston is shown at the bottom of its stroke. Seal 331 located between the inside of the piston and extension tube 324 acts against well pressure. Well pressure also acts against seals 330 between the piston and bore 328 of the intensifier housing. Fluid contained in cavity 336 acts on the small side of the piston and is therefore at a higher pressure than the well fluid. Seal 329 between bore 327 and the piston and seal 398 between the extension tube and the inner diameter of the piston are acted on by the pressurization fluid.

Extension tube 324 may be part of housing 326, but for ease of manufacturing it may be sealed to and secured to the housing. FIG. 7 illustrates an O-ring seal 339 with bolts 340 securing the tube to the housing but many other methods are possible. Passage 337 is a breather hole to allow air to escape or flow into the area between the external seals on the piston. O-ring seals 354 and 355 have the same function as with all the double wall standpipe embodiments. They act to seal the standpipe to the housing in two places with pressurization fluid flowing into the passage 321 between the two seals.

For ease of manufacturing, FIG. 7 illustrates a step in the cylinder housing bore but a piston having a larger area on the bottom side than the top side can also be achieved by a stepped extension tube and a cylinder housing with a straight bore.

FIG. 8 is a preferred embodiment of a stand-alone stuffing box mounted in a wellhead frame using a floating single wall standpipe with a pressurization system. Space is often a constraint when retrofitting stuffing boxes to existing equipment. In general terms, the sealing system is equivalent to FIG. 4, except the pressurization seal 347 has been removed from the annulus between the shaft and the standpipe and is relocated to the annulus between the shaft and the housing. The lantern ring has been eliminated since the leakage path past the primary rotary seal is between the shaft and the standpipe. Elimination of the lantern ring and relocating of the secondary seal saves axial length and this is an advantage where space is constrained. However, the pressurization seal cannot be field serviced without removal and disassembly of the stuffing box.

Pressurization fluid is introduced through fluid passage 399. Pressurization fluid pressure may be indicated on pressure gauge 314. Pressurization seal 347 is preferably a high pressure lip seal. It may be fitted into a groove or retained by, for example, a spacer ring 348 and a retaining ring such as a snap ring 349. A single wall standpipe 92 is secured to housing 52 by special fastener 309 which prevents rotary and axial displacement. The special fastener is sealed to housing 52 to prevent loss of well fluids. As with embodiments shown in FIGS. 4, 5, 6, and 7, the standpipe can be fastened to permit inspection and replacement through the top of the stuffing box stuffing. FIG. 4 is not shown with the upwardly removable standpipe but it can be done in the same manner illustrated by FIG. 8.

Preferably, the primary seal is comprised of a high pressure lip 305 seal acting first against wellhead pressure in series with packings 116 acting once the lip seal has failed. The principles have already been described under the description of FIG. 4. Alternately, only the high pressure lip seal or only packings may be used. The advantage of packings is that they are split and can thus be replaced without removing the drive head from the wellhead frame 311.

In this embodiment, bearings 312 and 313 are preferably greased. Grease nipple 346 and grease relief 345 are for purposes of adding grease to the housing. Alternately, the bearings may be in an oil bath. Housing cap 344 can be removed for repair of seals or bearings. Primary seals 305 and 116 can be serviced from above the stuffing box as previously described.

FIG. 9 is a preferred embodiment of a stand alone stuffing box constructed with a non-rotating tubular shaft 357 bearingly supporting a rotating housing 356. The bearings 358 and 359 can be lubricated with the pressurization fluid as it travels toward the lower side of the primary seal 116 along fluid passages 368 and 369. This configuration is simpler to construct than a double wall standpipe but it uses more length and does not align the standpipe and the body as well as the double wall standpipe configuration because the primary seal and pressurization seal are outside the bearing supports and self alignment is not possible. The primary rotary seal 116 is field serviceable without removing the stuffing box from the well but the pressurization seal 360 is not. It may be preferable to use a high pressure lip seal as the pressurization seal to save axial space. Pressurization fluid that escapes past the pressurization seal is preferably returned to the pressurization source though fluid passage 367. Collection of leaked pressurization fluid is provided for by oil seal 361 which is preferably protected by flinger seal 362.

Figure 10:
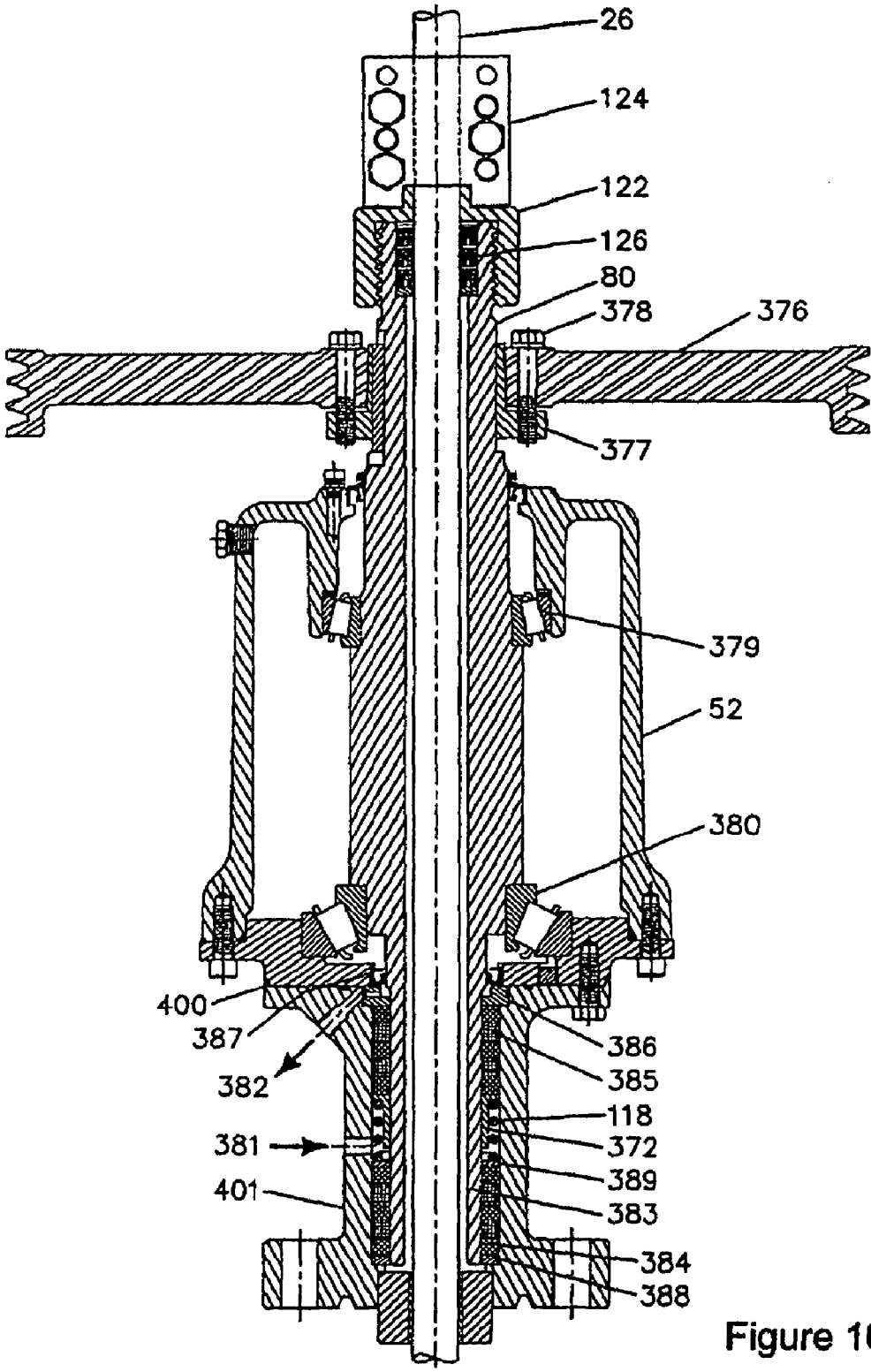
FIG. 10 is a preferred embodiment of a drive head with an integral stuffing box mounted on the bottom of the drive head with a pressurization system.
Figure 11:
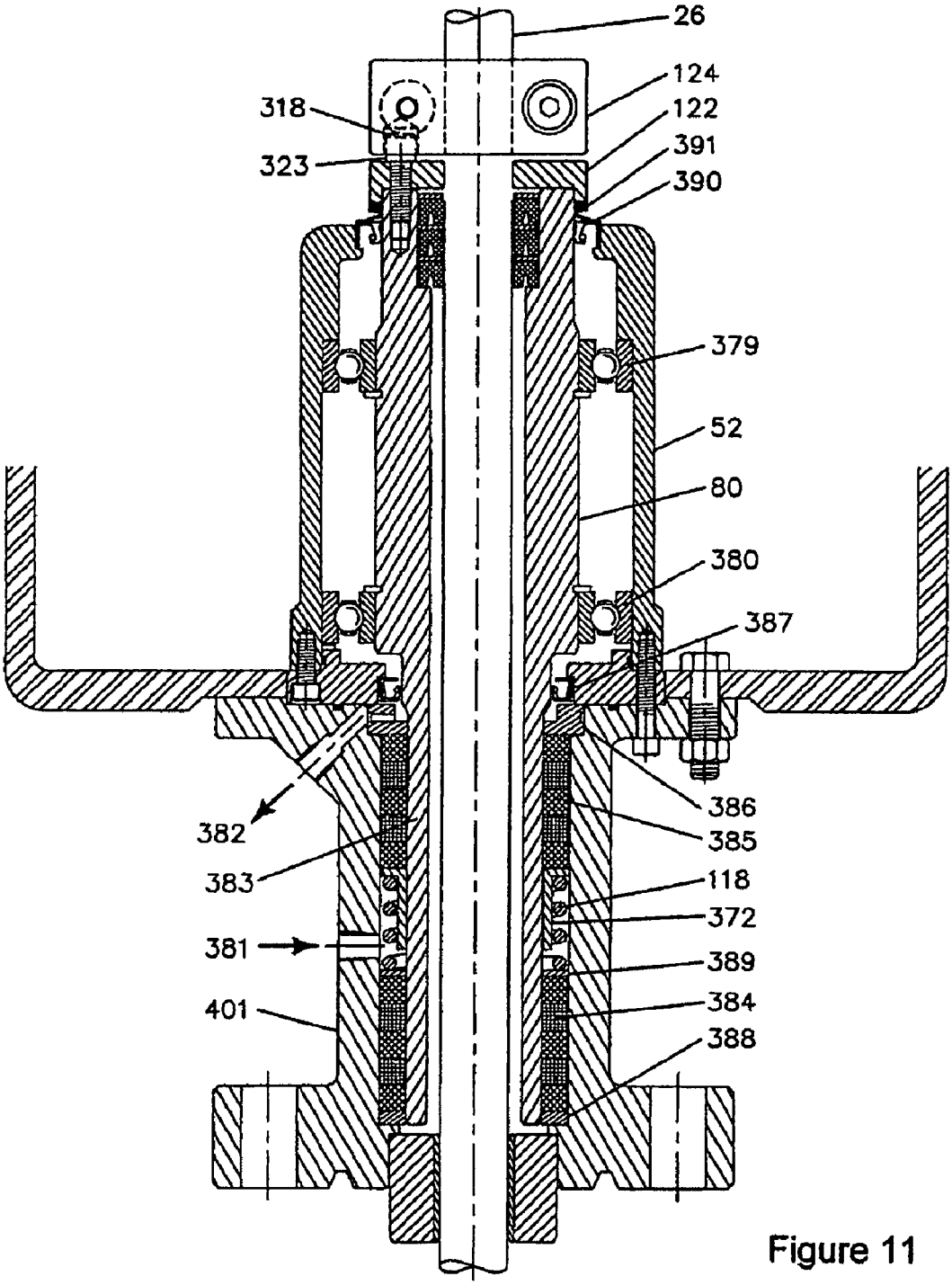
FIG. 11 is a stand-alone stuffing box similar to and using the same principles as the integral stuffing box shown in FIG. 10.

FIG. 10 is a preferred embodiment of a drive head with an integral stuffing box mounted on the bottom of the drive head with a pressurization system. In some cases, hydraulic pressure is readily available to provide for stuffing box pressurization. However, the standpipe system requires a large shaft and large bearings, which may be too expensive for some applications. In these cases, a bottom-mounted stuffing box with a pressurization system may be an economic solution. This can be done with the stuffing box integral with the drive head or as a stand-alone stuffing box mounted in a wellhead frame as shown in FIG. 11. In this preferred embodiment shown in FIGS. 10 and 11, there are a pressurization seal and a primary seal preferably comprising two sets of packings separated by a packing preload spring that acts as a lantern ring. The packings run on a hard sleeve that is supported on an extension 383 of the main shaft 80 of the drive head. The main shaft is supported by bearings 379, 380 and the stuffing box is fitted to the drive head with a pilot diameter 400 to align the rotating shaft with the rotary stuffing box seals. Although alignment is not as good as with a floating standpipe, this is a cost effective solution, suitable in conditions where stuffing box wear is not severe. In this embodiment the primary rotary seal 384 is located at the bottom of the stuffing box. The upper seal 385 is the pressurization seal. Since the pressurization seal is sealing against lubricant, wear of the pressurization seal and shaft extension 383 is generally not severe. It may be preferable to use one or more lip seals as the pressurization seal rather than packings because they need less space and have no leakage.

Lubricant leakage passing through the pressurization seal should not be allowed to enter the housing 52 through the lower shaft seal 387. For this reason a spacer ring 386 is placed above the pressurization seal 385 to allow pressurization fluid to escape through passage 382. Pressurization fluid enters the stuffing box through passage 381 and pushes against both sets of packings together with preload spring 118. Packing pusher 372 loads the pressurization packing 385 while spacer ring 389 pushes against primary packing 384. Spacer ring 388 or an equivalent shape in stuffing box housing 401 prevents packing extrusion.

FIG. 11 is a stand-alone stuffing box similar to and using the same principles as the integral stuffing box shown in FIG. 10 except in this case the stuffing box is driven by the polished rod.

I claim:

1. A stuffing box for sealing around a polished rod in a well, comprising:

a housing;

a tubular shaft rotatably mounted in said housing concentrically receiving said polished rod;

a non-rotatable tubular standpipe concentrically received within said shaft and detachably secured to said housing;

a source of pressurization fluid;

an upper primary rotary seal in contact with well fluid on its upper side and pressurization fluid on its lower side disposed in an annulus between said standpipe and said shaft;

a lower pressurization rotary seal acting to hold pressurization fluid against the upper seal disposed in the annulus between said standpipe and said shaft; and said standpipe having internal fluid passages therein for communicating pressurization fluid from said housing to said annulus within an annular area between said upper and said lower rotary seals.

2. A stuffing box as defined in claim 1, said upper primary rotary seal being removable upwardly through said shaft to facilitate servicing of said seal.

3. A stuffing box as defined in claim 1, said upper primary rotary seal and said lower pressurization rotary seal being removable upwardly through said shaft to facilitate servicing of said seals.

4. A stuffing box as defined in claim 1, said standpipe being removable upwardly through said shaft to facilitate inspection and replacement of said standpipe.

5. A stuffing box as defined in claim 1, said upper primary rotary seal and said lower pressurization rotary seal and said standpipe being removable upwardly through said shaft to facilitate servicing.

6. A stuffing box for sealing around a polished rod in a well, comprising:

a housing;

a tubular shaft rotatably mounted in said housing concentrically receiving said polished rod;

a non-rotatable tubular standpipe concentrically received within said shaft and detachably secured to said housing;

a source of pressurization fluid;

an upper primary rotary seal in contact with well fluid on its upper side and pressurization fluid on its lower side disposed in an annulus between said standpipe and said shaft;

a lower pressurization rotary seal acting to hold pressurization fluid against the upper seal disposed in the annulus between said standpipe and said shaft;

static seal means to seal well fluids between said polished rod and said shaft;

a drive cap secured to said shaft that can be removed to permit access to said static seal means and said upper rotary seal; and said standpipe having internal fluid passages therein for communicating pressurization fluid from said housing to said annulus within an annular area between said upper and said lower rotary seals.

7. A stuffing box as defined in claim 6, said upper primary rotary seal being removable upwardly through said shaft to facilitate servicing of said seal.

8. A stuffing box as defined in claim 7, wherein said upper primary rotary seal is comprised of a packing, a lip seal, an elastomeric seal or a combination thereof.

9. A stuffing box as defined in claim 8, wherein said lower pressurization rotary seal is comprised of a packing, a lip seal, a labyrinth, an elastomeric seal or a combination thereof.

10. A stuffing box as defined in claim 9, said upper primary rotary seal and said lower pressurization seal being separated and preloaded by a spring.

11. A stuffing box as defined in claim 6, said upper primary rotary seal and said lower pressurization rotary seal being removable upwardly through said shaft to facilitate servicing of said seals.

12. A stuffing box as defined in claim 6, said standpipe being removable upwardly through said shaft to facilitate inspection and replacement of said standpipe.

13. A stuffing box as defined in claim 6, said upper primary rotary seal and said lower pressurization rotary seal and said standpipe being removable upwardly through said shaft to facilitate servicing.

14. A stuffing box as defined in claim 6, said static seal means including a static seal carrier sealed to the inside of said shaft and ring seals disposed between said polished rod and said static seal carrier.

15. A stuffing box for sealing around a polished rod in a well, comprising:

a housing;

a tubular shaft rotatably mounted in said housing concentrically receiving said polished rod;

a non-rotatable tubular standpipe concentrically received within said shaft and detachably secured to said housing;

an upper primary rotary seal in contact with well fluid on its upper side and in communication with a leakage passage on its lower side disposed in the annulus between said standpipe and said shaft;

a lower secondary rotary seal in communication with a leakage passage on its upper side acting to impede the entry of well fluid into said housing disposed in the annulus between said standpipe and said shaft;

a leakage passage between said upper and lower seals to carry away well fluids that have leaked past said upper seal;

static seal means to seal well fluids between said polished rod and said shaft;

a drive cap secured to said shaft that can be removed to permit access to said static seal means and said upper and said lower rotary seals;

removable clamp means connecting said polished rod to said drive cap;

said upper primary rotary seal being comprised of a lip seal in first contact with well fluid and rotary packings as the backup seal after said lip seal fails; and said lower secondary rotary seal including self lubricating packings, self lubricating lip seals and combinations thereof.

16. A stuffing box as defined in claim 15, said upper primary rotary seal being removable upwardly through said shaft to facilitate servicing of said seal.

17. A stuffing box as defined in claim 15, said upper primary rotary seal and said lower secondary rotary seal being removable upwardly through said shaft to facilitate servicing of said seals.

18. A stuffing box as defined in claim 15, said standpipe being removable upwardly through said shaft to facilitate inspection and replacement of said standpipe.

19. A stuffing box as defined in claim 15, said upper primary rotary seal and said lower pressurization rotary seal and said standpipe being removable upwardly through said shaft to facilitate servicing.

20. A stuffing box as defined in claim 15, said static seal means including a static seal carrier sealed to the inside of said shaft and ring seals disposed between said polished rod and said static seal carrier.

21. A stuffing box for sealing around a polished rod in a well, comprising:

a housing;

a tubular shaft rotatably mounted in said housing concentrically receiving said polished rod;

a non-rotatable tubular standpipe concentrically received within said shaft and detachably secured to said housing;

a source of pressurization fluid;

an upper primary rotary seal in contact with well fluid on its upper side and pressurization fluid on its lower side disposed in an annulus between said standpipe and said shaft;

a lower pressurization rotary seal acting to hold pressurization fluid against the upper seal disposed in an annulus between said housing and said shaft;

static seal means to seal well fluids between said polished rod and said shaft; and a drive cap secured to said shaft that can be removed to permit access to said static seal means and said upper rotary seal.

22. A stuffing box as defined in claim 21, said upper primary rotary seal being removable upwardly through said shaft to facilitate servicing of said seal.

23. A stuffing box as defined in claim 22, said standpipe being removable upwardly through said shaft to facilitate inspection and replacement of said standpipe.

24. A stuffing box as defined in claim 22, wherein said upper primary rotary seal is comprised of a packing, a lip seal or a combination thereof.

25. A stuffing box as defined in claim 24, said upper primary rotary seal preloaded by a spring.

26. A stuffing box as defined in claim 21, wherein said lower pressurization rotary seal is comprised of a packing, a lip seal, a labyrinth, an elastomeric seal or a combination thereof.

27. A stuffing box as defined in claim 21, said static seal means including a static seal carrier sealed to the inside of said shaft and ring seals disposed between said polished rod and said static seal carrier.

28. A stuffing box as defined in claim 21, further comprising removable clamp means connecting said polished rod to said drive cap.

29. A stuffing box for sealing around a polished rod in a well, comprising:

a tubular housing with an internal bore to concentrically receive said polished rod therethrough;

a tubular shaft bearingly mounted in said housing concentrically receiving said polished rod;

a hardened shaft extension projecting downward beyond the shaft support bearings, creating an annulus between said shaft extension and said housing;

a lower primary rotary seal disposed in the annulus between said shaft extension and said housing and in contact with well fluid on one side and pressurization fluid on its other side, wherein said primary seal is comprised of a braided packing or a braided packing with a lip seal below said packing;

an upper pressurization rotary seal disposed in the annulus between said shaft extension and said housing, acting to hold pressurization fluid against said primary seal, wherein said pressurization seal is comprised of a lip seal, a braided packing or a combination thereof;

static seal means to seal well fluids between said polished rod and said shaft;

a drive cap secured to said shaft that can be removed to permit access to said static seal means;

removable clamp means connecting said polished rod to said drive cap; and a source of pressurization fluid.

30. A stuffing box for sealing around a polished rod in a well, comprising:

a housing;

a tubular shaft rotatably mounted in said housing concentrically receiving said polished rod;

a primary rotary seal in contact with well fluid on one side and pressurization fluid on its other side;

a pressurization rotary seal acting to hold pressurization fluid against the primary seal;

static seal means to seal well fluids between said polished rod and said shaft;

a drive cap secured to said shaft that can be removed to permit access to said static seal means;

removable clamp means connecting said polished rod to said drive cap; and an intensifying cylinder assembly.

31. A source of pressurization fluid for a stuffing box, comprising:

an intensifying cylinder assembly including an annular passage to receive a polished rod therethrough;

said intensifying assembly including a piston with a large area exposed to well fluid pressure and a smaller area exposed to a fluid to be pressurized; and said fluid thus pressurized being made available to said stuffing box at a pressure greater than wellhead pressure.

32. A source of pressurization fluid for a stuffing box as defined in claim 31, said intensifying cylinder assembly including an intensifier housing, an extension tube concentrically disposed around the polished rod and sealed to said housing and said piston, with intensified pressure acting on an outside diameter of said extension tube.

33. A stuffing box for sealing around a polished rod in a well, comprising:

a non-rotating tubular shaft concentrically receiving said polished rod;

a rotating housing supported by bearings on said shaft;

a source of pressurization fluid;

an upper primary rotary seal in contact with well fluid on its upper side and pressurization fluid on its lower side disposed in an annulus between said housing and said shaft;

a lower pressurization rotary seal acting to hold pressurization fluid against the upper seal disposed in the annulus between said housing and said shaft;

static seal means to seal well fluids between said polished rod and said housing;

a drive cap secured to said housing that can be removed to permit access to said static seal means and said upper rotary seals; and said shaft having internal fluid passages therein for communicating pressurization fluid from said shaft to said annulus within an annular area between said upper and said lower rotary seals.

34. A stuffing box as defined in claim 33, said upper primary rotary seal being removable upwardly through said housing to facilitate servicing of said seal.

35. A stuffing box as defined in claim 34, wherein said upper primary rotary seal is comprised of a packing, a lip seal or a combination thereof.

36. A stuffing box as defined in claim 35, wherein said lower pressurization rotary seal is comprised of a packing, a lip seal, a labyrinth, an elastomeric seal or a combination thereof.

37. A stuffing box as defined in claim 35, said upper primary rotary seal being preloaded by a spring.

38. A stuffing box as defined in claim 33, said static seal means including a static seal carrier sealed to the inside of said housing and ring seals disposed between said polished rod and said static seal carrier.

39. A stuffing box as defined in claim 33, further comprising removable clamp means connecting said polished rod to said drive cap.

40. A stuffing box for sealing around a polished rod in a well, comprising:

a housing;

a tubular shaft rotatably mounted in said housing concentrically receiving said polished rod;

a non-rotatable tubular standpipe concentrically received within said shaft and detachably secured to said housing;

an upper primary rotary seal in contact with well fluid on its upper side and in communication with a leakage passage on its lower side disposed in the annulus between said standpipe and said shaft;

a lower secondary rotary seal in communication with a leakage passage on its upper side acting to impede the entry of well fluid into said housing disposed in the annulus between said standpipe and said shaft;

a leakage passage between said upper and lower seals to carry away well fluids that have leaked past said upper seal;

static seal means to seal well fluids between said polished rod and said shaft; and a drive cap secured to said shaft that can be removed to permit access to said static seal means and said upper and said lower rotary seals.

41. A stuffing box as defined in claim 40, said upper primary rotary seal being removable upwardly through said shaft to facilitate servicing of said seal.

42. A stuffing box as defined in claim 40, said upper primary rotary seal and said lower secondary rotary seal being removable upwardly through said shaft to facilitate servicing of said seals.

43. A stuffing box as defined in claim 40, said standpipe being removable upwardly through said shaft to facilitate inspection and replacement of said standpipe.

44. A stuffing box as defined in claim 40, said upper primary rotary seal and said lower pressurization rotary seal and said standpipe being removable upwardly through said shaft to facilitate servicing.

45. A stuffing box as defined in claim 40, said static seal means including a static seal carrier sealed to the inside of said shaft and ring seals disposed between said polished rod and said static seal carrier.

46. A stuffing box for sealing around a polished rod in a well, comprising:

a tubular housing with an internal bore to concentrically receive said polished rod therethrough;

a tubular shaft bearingly mounted in said housing concentrically receiving said polished rod;

a hardened shaft extension drivingly connected to said shaft projecting downward beyond the shaft support bearings, creating an annulus between said shaft extension and said housing;

a lower primary rotary seal disposed in the annulus between said shaft extension and said housing and in contact with well fluid on one side and pressurization fluid on its other side;

an upper pressurization rotary seal disposed in the annulus between said shaft extension and said housing, acting to hold pressurization fluid against said primary seal;

static seal means to seal well fluids between said polished rod and said shaft;

a drive cap secured to said shaft that can be removed to permit access to said static seal means; and a source of pressurization fluid.

47. A stuffing box as defined in claim 46 wherein said lower primary rotary seal is comprised of a braided packing, a lip seal, an elastomeric seal or a combination thereof.

48. A stuffing box as defined in claim 46 wherein said upper pressurization rotary seal is comprised of a packing, a lip seal, a labyrinth, an elastomeric seal or a combination thereof.

49. A stuffing box as defined in claim 47, said lower primary rotary seal and said upper pressurization rotary seal being separated and preloaded by a spring.

50. A stuffing box as defined in claim 48, said lower primary rotary seal and said upper pressurization rotary seal being separated and preloaded by a spring.

51. A stuffing box as defined in claim 46, said static seal means including a static seal carrier sealed to the inside of said shaft and ring seals disposed between said polished rod and said static seal carrier.

52. A stuffing box for sealing around a polished rod in a well, comprising:

a housing;

a tubular shaft rotatably mounted in said housing concentrically receiving said polished rod;

a primary rotary seal in contact with well fluid on one side and pressurization fluid on its other side;

a pressurization rotary seal acting to hold pressurization fluid against the primary seal;

static seal means to seal well fluids between said polished rod and said shaft;

a drive cap secured to said shaft that can be removed to permit access to said static seal means; and an intensifying cylinder assembly.

53. A stuffing box as defined in claim 52, said intensifying cylinder assembly comprising:

a piston with a large area exposed to well fluid pressure and a smaller area exposed to a fluid to be pressurized; and said fluid thus pressurized being made available to said stuffing box at a pressure greater than wellhead pressure.

54. A stuffing box as defined in claim 53, said intensifying cylinder assembly including an annular passage to receive said polished rod therethrough.

55. A stuffing box as defined in claim 54, said intensifying cylinder assembly including an internal passage for pressurized fluid to enter said stuffing box without need for external plumbing between said intensifier cylinder and said stuffing box.

56. A stuffing box as defined in claim 55, said intensifying cylinder assembly including an intensifier housing, an extension tube concentrically disposed around the polished rod and sealed to said housing and said piston, with intensified pressure acting on an outside diameter of said extension tube.

57. A source of pressurization fluid for a stuffing box, comprising:

an intensifying cylinder assembly;

said intensifying assembly including a piston with a large area exposed to well fluid pressure and a smaller area exposed to a fluid to be pressurized;

said fluid thus pressurized being made available to said stuffing box at a pressure greater than wellhead pressure; and said intensifying cylinder assembly further including an internal passage for pressurized fluid to enter said stuffing box without need for external plumbing between said intensifying cylinder assembly and said stuffing box.

58. A source of pressurization fluid for a stuffing box as defined in claim 57, said intensifying cylinder assembly including an intensifier housing, an extension tube concentrically disposed around the polished rod and sealed to said housing and said piston, with intensified pressure acting on an outside diameter of said extension tube.

* * * * *